US009130309B2

(12) United States Patent
Ozeki

(10) Patent No.: US 9,130,309 B2
(45) Date of Patent: Sep. 8, 2015

(54) ELECTRICAL CONNECTOR

(71) Applicant: Dai-ichi Seiko Co., Ltd., Kyoto-shi, Kyoto (JP)

(72) Inventor: Kosuke Ozeki, Ogori (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 14/481,737

(22) Filed: Sep. 9, 2014

(65) Prior Publication Data

US 2015/0087178 A1 Mar. 26, 2015

(30) Foreign Application Priority Data

Sep. 20, 2013 (JP) ..... 2013-196218

(51) Int. Cl.

| | |
|---|---|
| ***H01R 13/639*** | (2006.01) |
| ***H01R 13/627*** | (2006.01) |
| ***H01R 43/26*** | (2006.01) |
| ***H01R 12/71*** | (2011.01) |
| ***H01R 13/633*** | (2006.01) |
| *H01R 12/79* | (2011.01) |

(52) U.S. Cl.

CPC ..... *H01R 13/6275* (2013.01); *H01R 12/716* (2013.01); *H01R 13/633* (2013.01); *H01R 43/26* (2013.01); *H01R 12/79* (2013.01)

(58) Field of Classification Search

CPC .. H01R 43/26; H01R 13/6275; H01R 13/633; H01R 12/79; H01R 13/639

USPC ..... 439/74, 352

See application file for complete search history.

(56) References Cited

U.S. PATENT DOCUMENTS

| | | | | |
|---|---|---|---|---|
| 5,836,773 | A * | 11/1998 | McHugh et al. | 439/74 |
| 7,112,091 | B2 * | 9/2006 | Okura et al. | 439/570 |
| 7,901,218 | B2 * | 3/2011 | Sato et al. | 439/74 |
| 2003/0100211 | A1 * | 5/2003 | Wu | 439/328 |
| 2013/0280926 | A1 * | 10/2013 | Ono | 439/65 |

FOREIGN PATENT DOCUMENTS

| | | | |
|---|---|---|---|
| JP | 2006-100240 | A | 4/2006 |
| JP | 4287825 | B2 | 7/2009 |
| JP | 4613927 | B2 | 1/2011 |
| JP | 2011-065861 | A | 3/2011 |
| JP | 4675200 | B2 | 4/2011 |
| JP | 4910201 | B2 | 4/2012 |
| JP | 4954253 | B2 | 6/2012 |
| JP | 2013-089474 | A | 5/2013 |
| JP | 2013-101909 | A | 5/2013 |
| JP | 5250450 | B2 | 7/2013 |
| JP | 5523781 | B2 | 6/2014 |

* cited by examiner

*Primary Examiner* — Briggitte R Hammond

(74) *Attorney, Agent, or Firm* — Howard & Howard Attorneys PLLC

(57) ABSTRACT

An electrical connector that can prevent an unexpected length of time from being spent in separating the mated connectors is provided. The supporting portion is a plate-like member forming a slot in which a jig can be inserted in cooperation with the operation portion when the plug housing and receptacle housing are mated, and serves as the fulcrum point of leverage while the jig inserted in the slot and working as a lever abuts against the operation portion and deforms the elastic portion so as to disengage the latching portion and engaging portion.

7 Claims, 17 Drawing Sheets

ELECTRICAL CONNECTOR

CROSS-REFERENCE TO RELATED APPLICATION

This application claims the benefit of Japanese Patent Application No. 2013-196218, filed on Sep. 20, 2013, the entire disclosure (specification, the scope of the claims and drawings) of which is incorporated by reference herein.

FIELD

This application relates to an electrical connector.

BACKGROUND

As an electrical connector including two connectors (for example, plug and receptacle) constructed to mate and electrically connecting a substrate on which one connector is mounted and a substrate on which the other connector is mounted and when the connectors are mated, for example, the electrical connector described in Patent Literature 1 is known.

The above electrical connector includes a plug reinforcing a fitting provided on the plug connector and a receptacle reinforcement fitting provided on the receptacle connector. The worker engages the engaging protrusion of the plug reinforcing fitting with the engaging hole of the receptacle reinforcing fitting to mate the plug connector and receptacle connector.

In order to separate the mated plug connector and receptacle connector, the worker first inserts the tip of a scissors-like jig into the release hole of the substrate on which the plug connector is mounted. The worker further inserts the tip of the jig into the jig insert hole formed in the receptacle reinforcing fitting. Then, the worker operates the jig to elastically deform the plug reinforcing fitting to release the engaging protrusion of the plug reinforcing fitting from the engaging hole of the receptacle reinforcing fitting so as to disengage the engaging protrusion and engaging hole. In this state, the worker pulls the plug connector away from the receptacle connector to separate the mated plug connector and receptacle connector.

As described above, in order to separate the mated plug connector and receptacle connector, the worker has to insert the tip of a scissors-like jig first into the release hole of the substrate and further into the jig insert hole of the receptacle reinforcing fitting. Thus, the electrical connector described in the Patent Literature 1 can prevent the engaging protrusion and engaging hole from being disengaged by mistake.

[Patent Literature 1] Unexamined Japanese Patent Application Kokai Publication No. 2011-65861.

SUMMARY

Here, the electrical connector described in the Patent Literature 1 is supposedly used as follows.

First, when the substrate on which the electrical connector described in the Patent Literature 1 is mounted and the electrical connector are nearly equal in size, the tip of the jig can be inserted in the exposed engaging hole of the receptacle reinforcing fitting directly. Therefore, there is no need to form a release hole in the substrate. In other words, supposedly, a substrate with no release hole is used.

Furthermore, when the plug reinforcing fitting and receptacle reinforcing fitting are provided only at one end of the electrical connector, not at both ends of the electrical connector, and a hinge or the like holds the electrical connector at the other end, for example, as in the Patent Literature 1, the worker can use a rod-like jig, not a scissors-like jig. In other words, supposedly, a rod-like jig is used.

In order to separate the mated plug connector and receptacle connector when the electrical connector is used as supposed above, the worker has to insert the tip of a rod-like jig into the jig insert hole of the receptacle reinforcing fitting and operate the jig to elastically deform the plug reinforcing fitting so as to release the engaging protrusion from the engaging hole.

In doing so, because there is no fulcrum point for securing the jig, the tip of the jig may come out from the jig insert hole or it may be difficult to convey the force from the jig to the plug reinforcing fitting. Therefore, when used as supposed above, the electrical connector described in the Patent Literature 1 has the problem that the worker may spend an unexpected length of time to separate the mated connectors.

The present disclosure is made with the view of the above situation and an objective of the present disclosure is to provide an electrical connector that can prevent a worker from spending an unexpected length of time separating the mated connectors.

Solution to Problem

In order to achieve the above objective, the electrical connector according to the present disclosure includes:

a first connector comprising a first housing forming an internal region with an insulation wall, and first contacts that are conductive members extending from the wall of the internal region toward the outside of the first housing; and a second connector comprising a second housing comprising an insulating wall that is placed at least in part within the internal region of the first housing, and second contacts that are conductive members extending from the wall of the second housing toward the outside of the second housing, in which the first contacts and the second contacts are electrically connected when the first housing and the second housing are mated, wherein one of the first connector or the second connector comprises:

a latching portion positioned to face the wall of the housing of the other connector when the housing of one connector and the housing of the other connector are mated;

an operation portion extending outward from one connector and connected to one end of the latching portion; and an elastic portion comprising a flexible member that is connected to the other end of the latching portion and mounted on the wall of the housing of one connector, and the other connector comprises:

an engaging portion provided on the wall of the housing of the other connector facing the latching portion when the housing of one connector and the housing of the other connector are mated for engaging with the latching portion; and a supporting portion that is a plate-like member forming a slot into which a jig can be inserted in cooperation with the operation portion when the housing of one connector and the housing of the other connector are mated and serving as the fulcrum point of leverage while the jig inserted in the slot and working as a lever abuts against the operation portion therefor deforming the elastic portion so as to disengage the latching portion and engaging portion from each other.

Furthermore, it is possible that the other connector comprises a protective portion connected continuously to the supporting portion within the slot and extending toward the operation portion for protecting the other members from being damaged by contacting with the jig working as a lever.

Furthermore, it is possible that the other connector comprises a reinforcing portion that is a plate-like member connected continuously to the supporting portion outside the slot and reinforces the supporting portion for improving the rigidity of the supporting portion.

Furthermore, it is possible that the latching portion abuts against the wall of the housing of one connector to limit the deformation of the elastic portion when the elastic portion deforms under the leverage of the jig.

Furthermore, it is possible that the latching portion comprises a latching piece in the shape of a protrusion, the engaging portion is a plate-like member provided with an engaging hole for engaging with the latching piece, and the latching piece abuts against the plate-like surface of the engaging portion and deforms the elastic portion when the housing of one connector and the housing of the other connector are mated and the latching piece is not engaged with the engaging hole so as to change the position of the operation portion and enlarge the slot compared with when the latching piece is engaged with the engaging hole.

Furthermore, it is possible that the engaging portion and the supporting portion are formed by a sheet of plate, and the engaging portion is fastened to the wall of the housing of the other connector.

Furthermore, it is possible that one connector comprises at least two of the elastic portions, the latching portions, and the operation portions at opposite positions, and the other connector comprises at least two of the engaging portions and the supporting portions at opposite positions.

Advantageous Effects of Invention

The supporting portion serves as the fulcrum point of leverage while a jig inserted in the slot and working as a lever abuts against the operation portion and deforms the elastic portion so as to disengage the latching portion and engaging portion. Thus, the electrical connector can improve the operability of the jig and prevent the worker from spending an unexpected length of time in order to separate the mated connectors.

BRIEF DESCRIPTION OF THE DRAWINGS

A more complete understanding of this application can be obtained when the following detailed description is considered in conjunction with the following drawings, in which.

DETAILED DESCRIPTION

An electrical connector 10 according to an embodiment of the present disclosure will be described hereafter. The electrical connector 10 shown in the perspective view of FIG. 1 includes a plug connector 20 and a receptacle connector 40 to be mated with the plug connector 20. The plug connector 20 and receptacle connector 40 are each mounted on a substrate.

Figure 1:
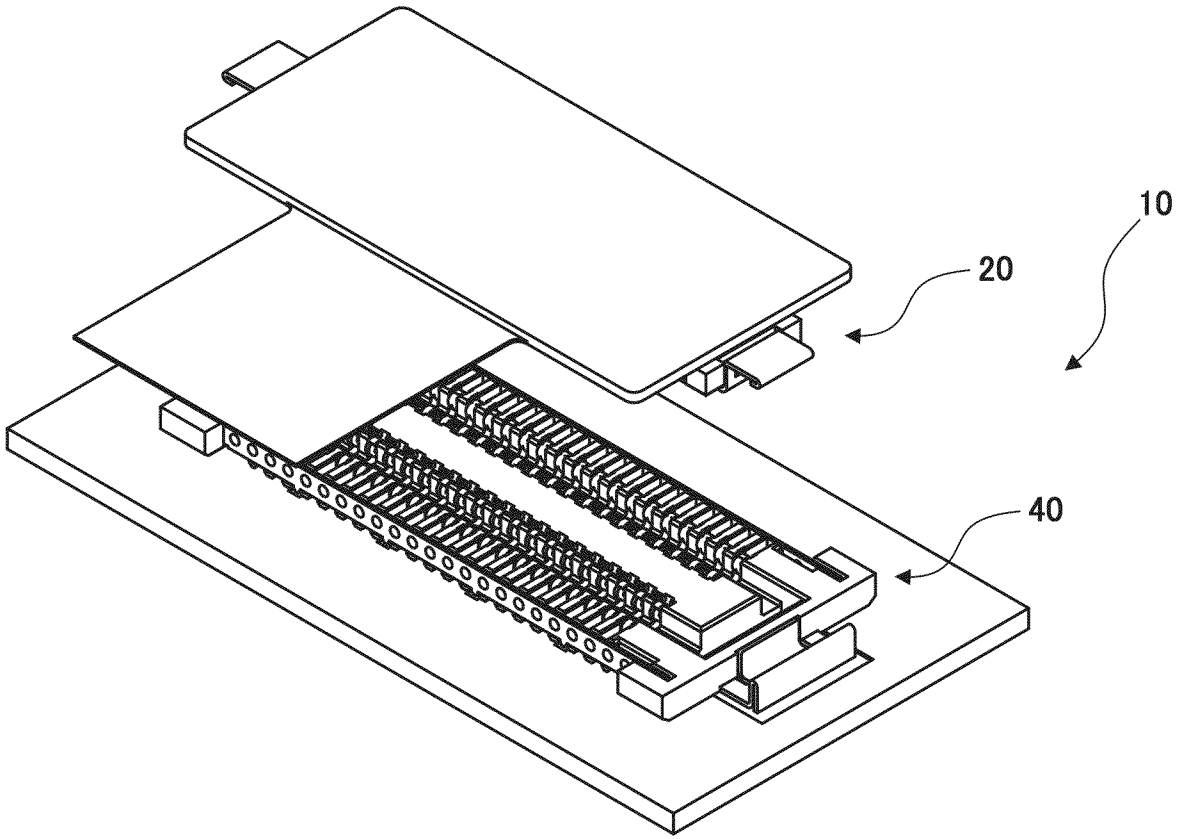
FIG. 1 is a perspective view of the electrical connector according to an embodiment of the present disclosure when mounted on substrates.
Figure 2:
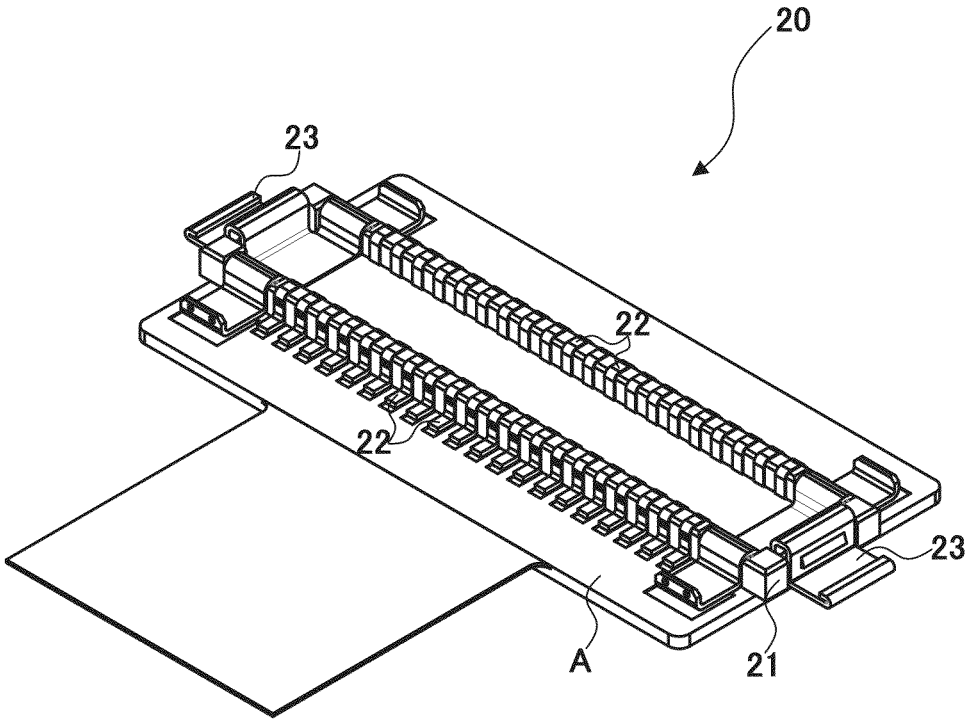
FIG. 2 is a perspective view of the plug connector mounted on a substrate.

The plug connector 20 is, as shown in the perspective view of FIG. 2 (the view of the plug connector 20 when seen from where the receptacle connector 40 is in FIG. 1), a rectangular frame that is placed at least in part within an internal region of the receptacle connector 40. The plug connector 20 includes a plug housing 21 including an insulating wall (for example, a plastic wall or the like).

The plug connector 20 further has plug contacts 22 that are conductive members (for example, conductive wires or the like) extending from the inner wall surface of the plug housing 21 toward the outside of the plug housing 21 via the outer wall surface of the plug housing 21. The plug contacts 22 are, for example, soldered to a flexible substrate A that is highly flexible.

The plug connector 20 includes locking parts 23 engaging with parts to be locked 44 provided to the receptacle connector 40, which will be described later. The locking parts 23 are provided at either end of the plug housing 21 in the longitudinal direction (the pitch direction along which the plug contacts 22 are arranged). As the locking parts 23 and parts to be locked 44 are engaged, the plug connector 20 and receptacle connector 40 are mated firmly.

The locking parts 23 each include a latching portion 23*a* provided with a latching piece 23*g* to engage with the part to be locked 44 described later as shown in the perspective view of FIG. 3 and the perspective view of FIG. 4 (the view of a locking part 23 when seen in the arrowed direction from the point F1 shown in FIG. 3). The locking part 23 further includes an operation portion 23*b* connected to one end of the latching portion 23*a* and an elastic portion 23*c* connected to the other end of the latching portion 23*a* at one end.

The locking part 23 further includes a base 23*d* connected to the other end of the elastic portion 23*c* and serving as the base of the locking part 23, mounting portions 23*e* connected to either end of the base 23*d*, and joints 23*f* connected to the mounting portions 23*e*.

The latching portion 23*a* is a flat rectangular plate of, for example, metal. The latching portion 23*a* is laid in an xz-plane as shown in FIGS. 3 and 4. The latching portion 23*a* is positioned to face the part to be locked 44 described later when the plug connector 20 and receptacle connector 40 are mated.

Figure 3:
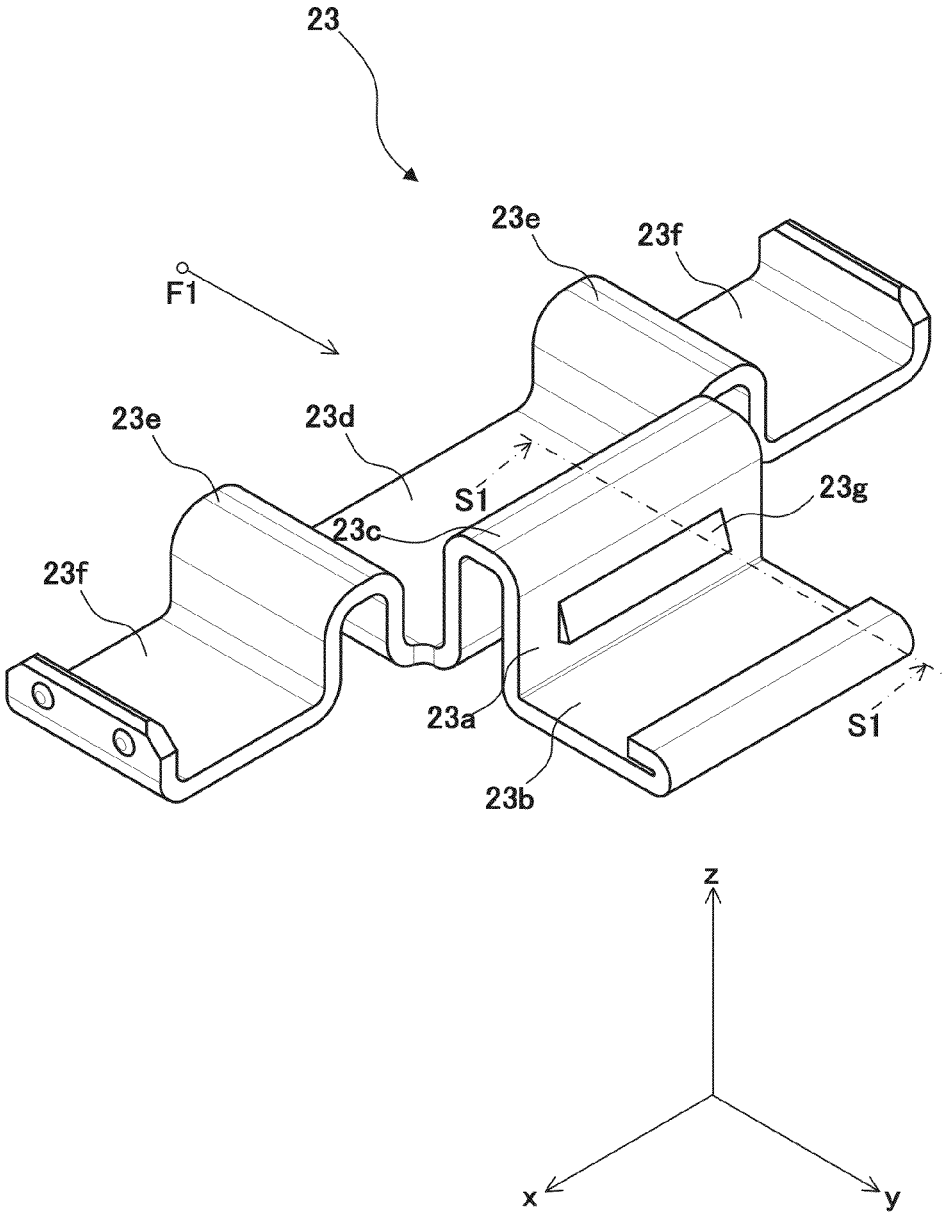
FIG. 3 is a first perspective view of a locking part.

As shown in FIG. 3, the latching portion 23*a* includes a latching piece 23*g* in the shape of a protrusion protruding toward the outside of the plug housing 21 (in the y-direction shown in FIG. 3). As the latching piece 23*g* is engaged with an engaging hole 44*f* of the part to be locked 44 described later, consequently, the locking part 23 and part to be locked 44 are engaged.

Figure 4:
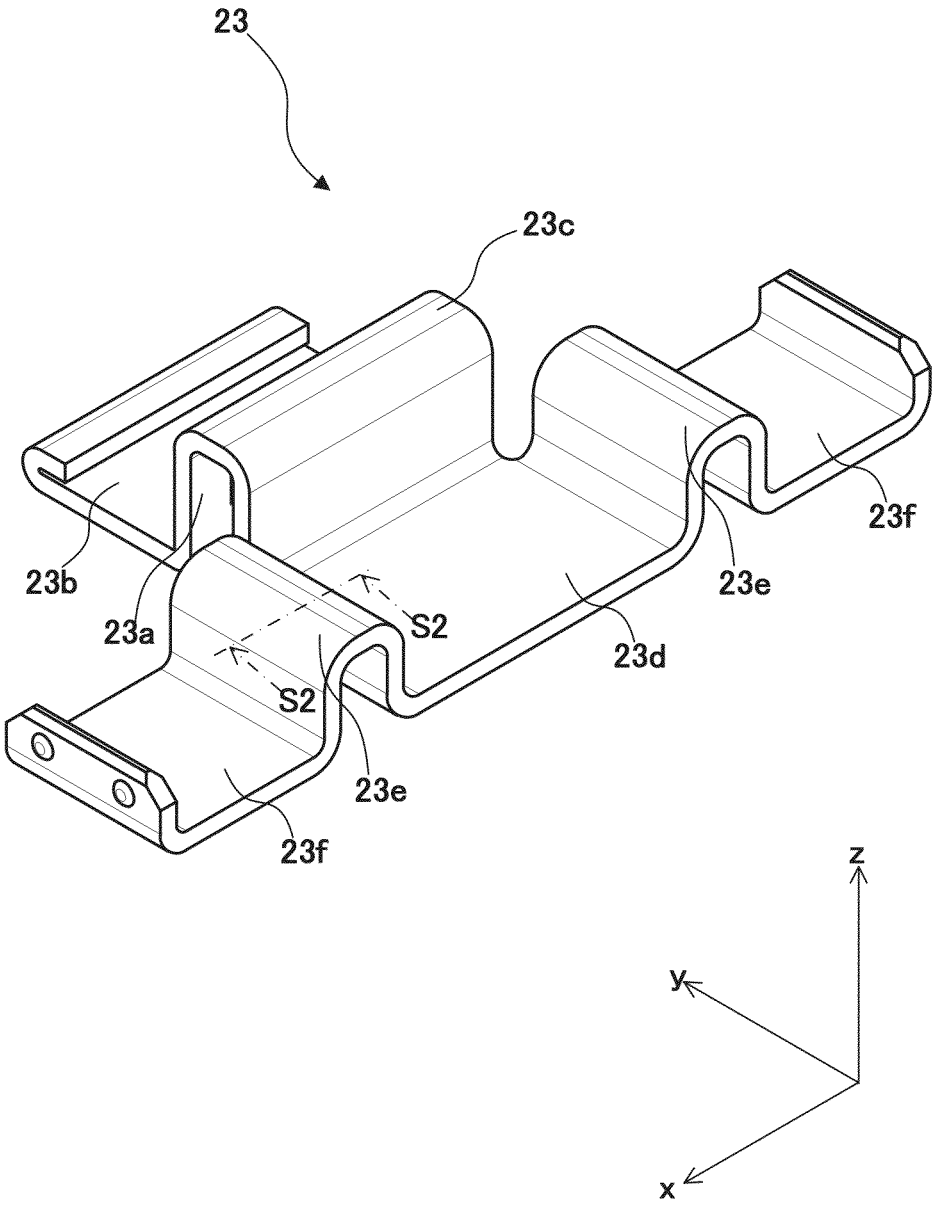
FIG. 4 is a second perspective view of a locking part.

The operation portion 23*b* is, as shown in FIGS. 3 and 4, a flat rectangular plate of, for example, metal, which is connected to one end of the latching portion 23*a* and extends outward from the plug housing 21 (in the y-direction shown in FIGS. 3 and 4). In other words, the operation portion 23*b* is laid in an xy-plane as shown in FIGS. 3 and 4. For example, in order to separate the mated plug connector 20 and receptacle connector 40 for replacing the plug connector 20, the worker abuts a rod-like jig (for example, a flat-blade screwdriver or the like) against the operation portion 23*b* and applies force to disengage the locking part 23 and part to be locked 44.

The elastic portion 23*c* includes a flexible member (for example, a copper alloy member). The elastic portion 23*c* has an inverted J shape projecting in the z-direction in a cross-section S1-S1 as shown in FIG. 3. One end of the elastic portion 23*c* is connected to the other end of the latching portion 23*a* as shown in FIGS. 3 and 4. The other end of the elastic portion 23*c* is connected to one side of the base 23*d*.

Furthermore, the planar section of the elastic portion 23*c* is laid in an xz-plane as shown in FIGS. 3 and 4. Then, the elastic portion 23*c*, latching portion 23*a*, and operation portion 23*b* present a dipper shape in a cross section S1-S1. This shape creates a space between the planar section of the elastic portion 23*c* and the latching portion 23*a*. With the wall of the plug housing 21 being placed in this space, as shown in FIG. 2, the elastic portion 23*c* is mounted on the wall of the plug housing 21 so as to cover the wall of the plug housing 21 in part.

The base 23*d* is a flat rectangular plate of, for example, metal, which is placed within the region enclosed by the wall of the plug housing 21 as shown in FIG. 2. The base 23*d* is laid in an xy-plane as shown in FIGS. 3 and 4. One side of the base 23*d* is connected to the other end of the elastic portion 23*c* as shown in FIGS. 3 and 4. The ends of the base 23*d* in the x-direction are connected to one end of each corresponding mounting portion 23*e*.

The mounting portions 23*e* have an inverted U shape projecting in the z-direction in a cross section S2-S2 as shown in FIG. 4. The mounting portions 23*e* are formed of, for example, a metal. The mounting portions 23*e* are each connected to an end of the base 23*d* at one end as shown in FIGS. 3 and 4.

For mounting the locking part 23 on the plug housing 21, the worker mounts the mounting portions 23*e* on the plug housing 21 so that the mounting portions 23*e* cover the wall of the plug housing 21 as shown in FIG. 2.

The joints 23*f* are each a flat rectangular plate of metal as shown in FIGS. 3 and 4. The joints 23*f* are laid in an xy-plane as shown in FIGS. 3 and 4. The joints 23*f* are each connected to the other end of a mounting portion 23*e* at one end. The joints 23*f* are soldered to the contact points of the flexible substrate A.

Figure 5:
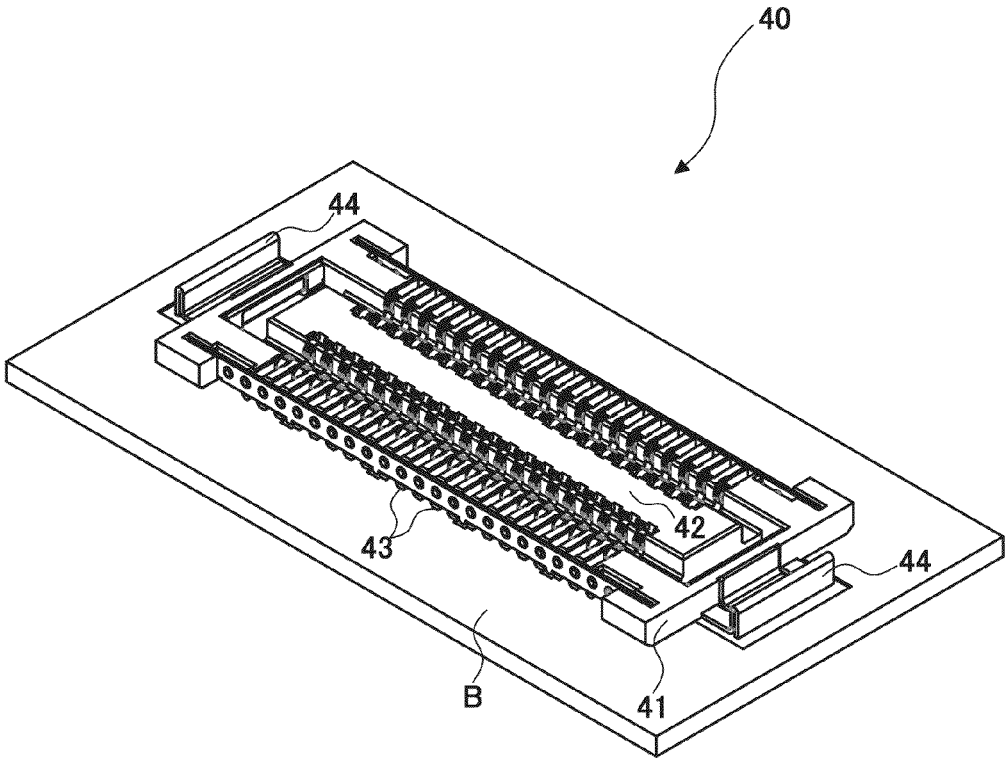
FIG. 5 is a perspective view of the receptacle connector mounted on a substrate.

The receptacle connector 40 includes a receptacle housing 41 that is a rectangular frame as shown in the perspective view of FIG. 5. The receptacle housing 41 forms an internal region with an insulating wall (for example, a plastic wall or the like) to house the plug housing 21. The receptacle connector 40 further includes an insulating rectangular parallelepiped block 42 placed in the internal region formed by the receptacle housing 41. The plug housing 21 is housed in the internal space created by the receptacle housing 41 and block 42.

The receptacle connector 40 further includes receptacle contacts 43 that are conductive members (for example, flat copper alloy plate members or the like) extending from the wall of the block 42 toward the outside of the receptacle housing 41 via the wall of the receptacle housing 41. The receptacle contacts 43 are, for example, soldered to the contact points of a slightly flexible circuit substrate B.

The receptacle connector 40 includes parts to be locked 44 engaging with the locking parts 23 of the plug connector 20. The parts to be locked 44 are placed at either end of the receptacle housing 41 in the longitudinal direction (the pitch direction along which the receptacle contacts 43 are arranged). The parts to be locked 44 are each formed by processing a sheet of plate as shown in the perspective view of FIG. 6 and the perspective view of FIG. 7 (the view of a part to be locked 44 when seen from the point F2 toward the arrowed direction shown in FIG. 6).

Figure 6:
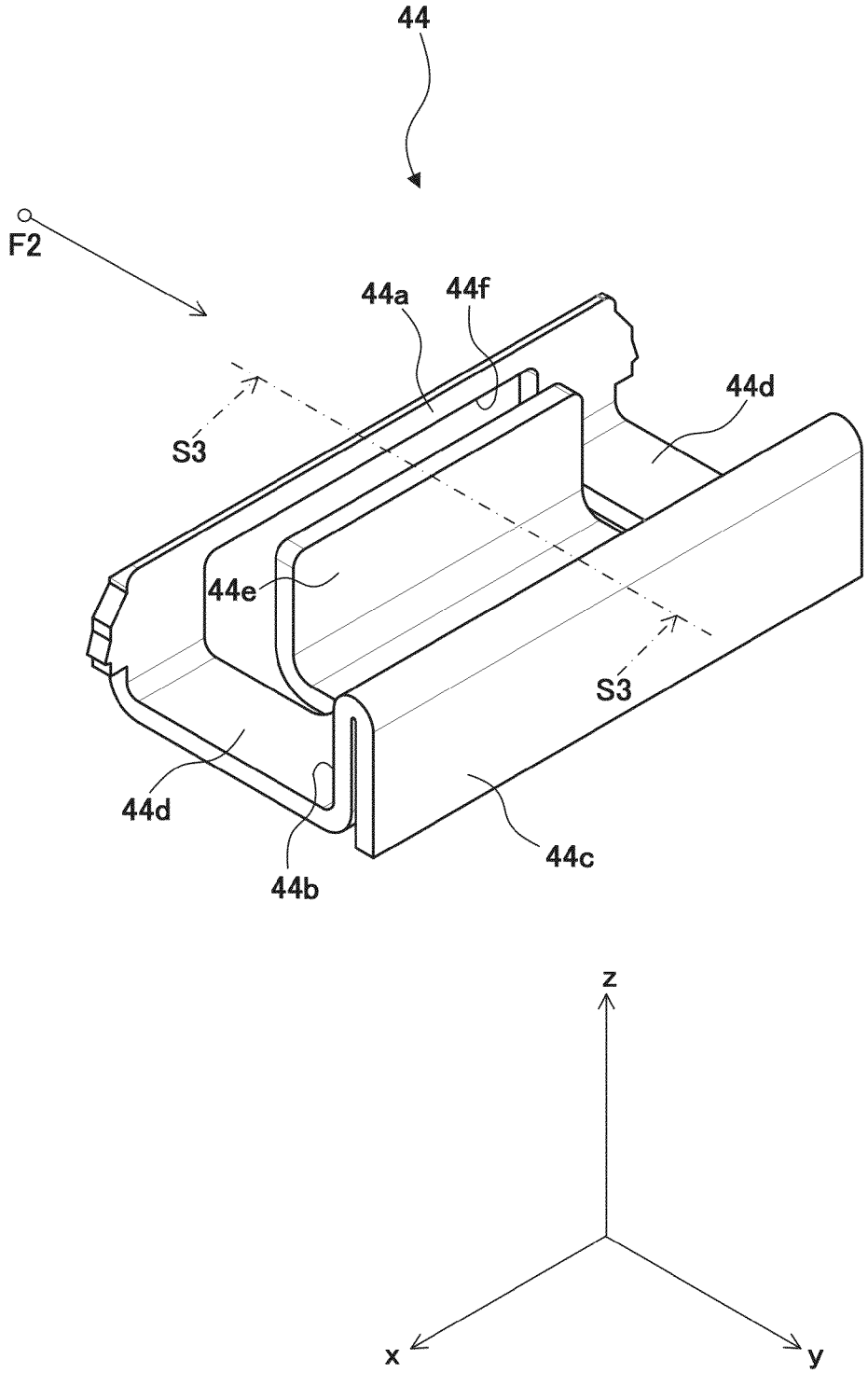
FIG. 6 is a first perspective view of a part to be locked.
Figure 7:
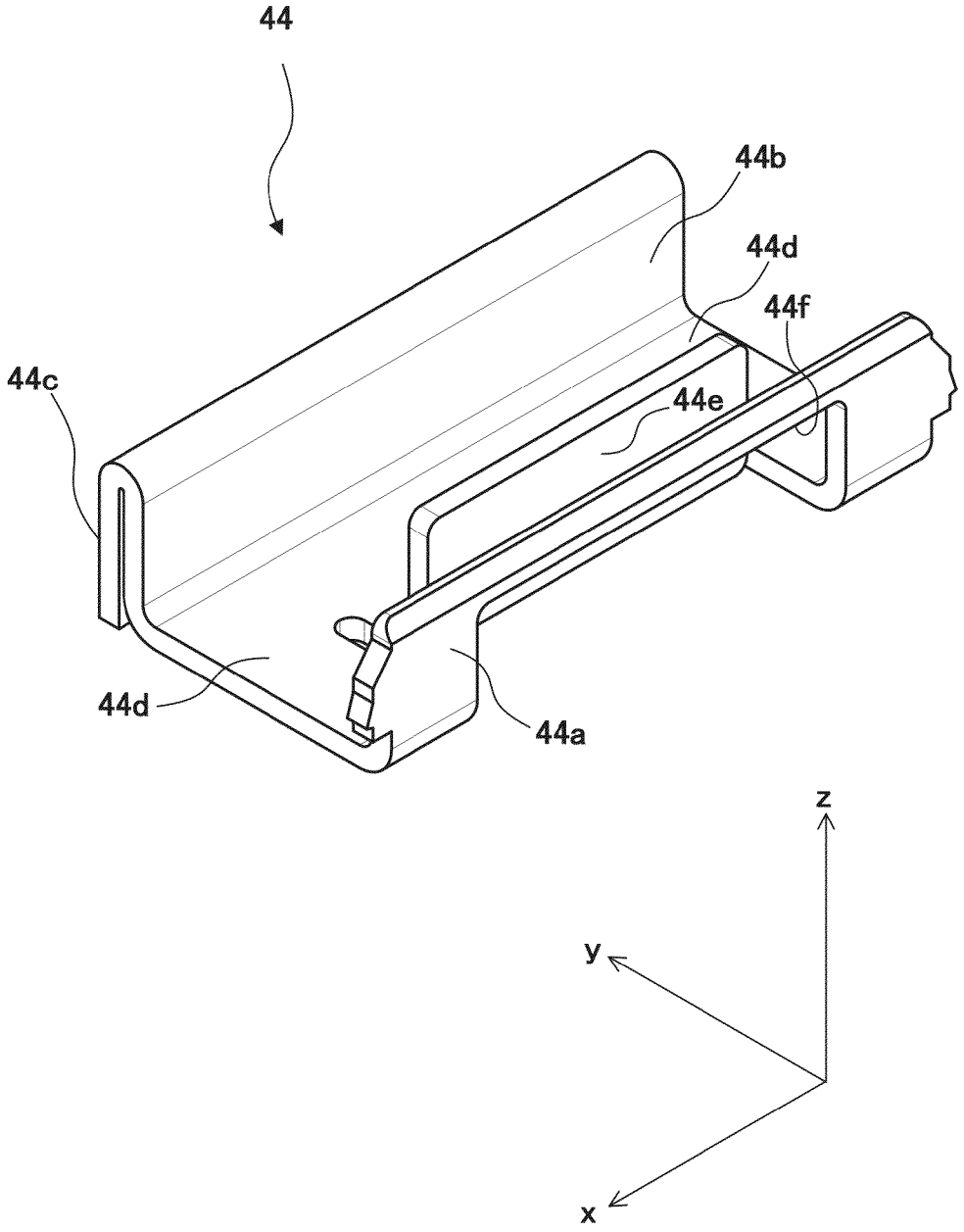
FIG. 7 is a second perspective view of a part to be locked.

The parts to be locked 44 each include, as shown in FIGS. 6 and 7, an engaging portion 44*a* engaging with the latching portion 23*a* of the locking part 23 and a supporting portion 44*b* placed nearly in parallel to the engaging portion 44*a*.

The part to be locked 44 further includes a reinforcing portion 44*c* connected continuously from the supporting portion 44*b*, a coupling portion 44*d* coupling the supporting portion 44*b* and engaging portion 44*a*, and a protective portion 44*e* provided between the engaging portion 44*a* and supporting portion 44*b*.

The engaging portion 44*a* is a flat plate of, for example, metal. The engaging portion 44*a* is laid in an xz-plane as shown in FIGS. 6 and 7. The engaging portion 44*a* is provided with an engaging hole 44*f* formed by punching out the flat plate in part. The engaging hole 44*f* is a hole to engage with the latching piece 23*g* of the latching portion 23*a*.

Figure 9A:
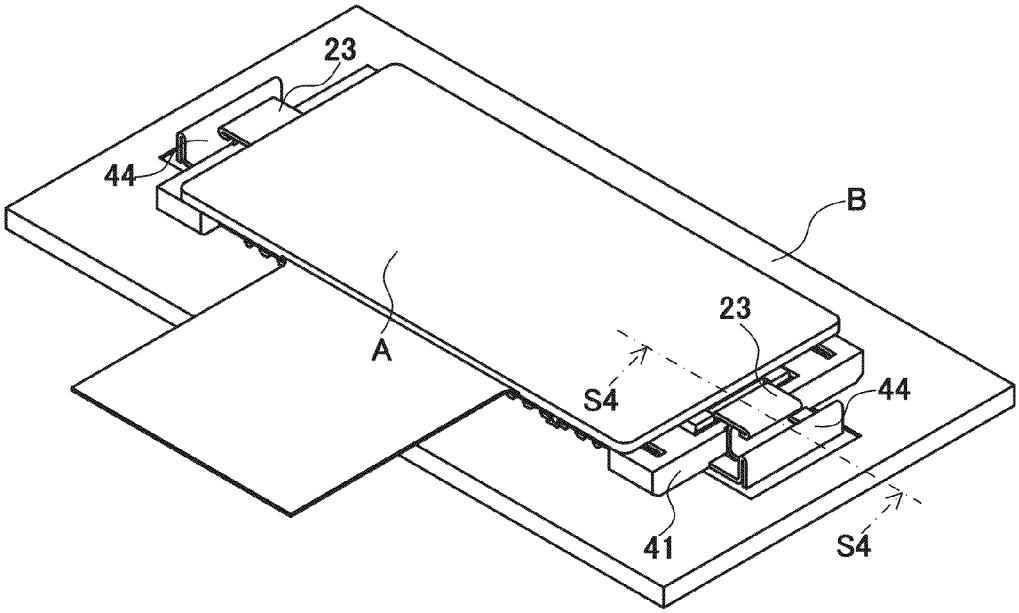
FIG. 9A is a perspective view of the electrical connector when the plug connector and receptacle connector are mated correctly.
Figure 9B:
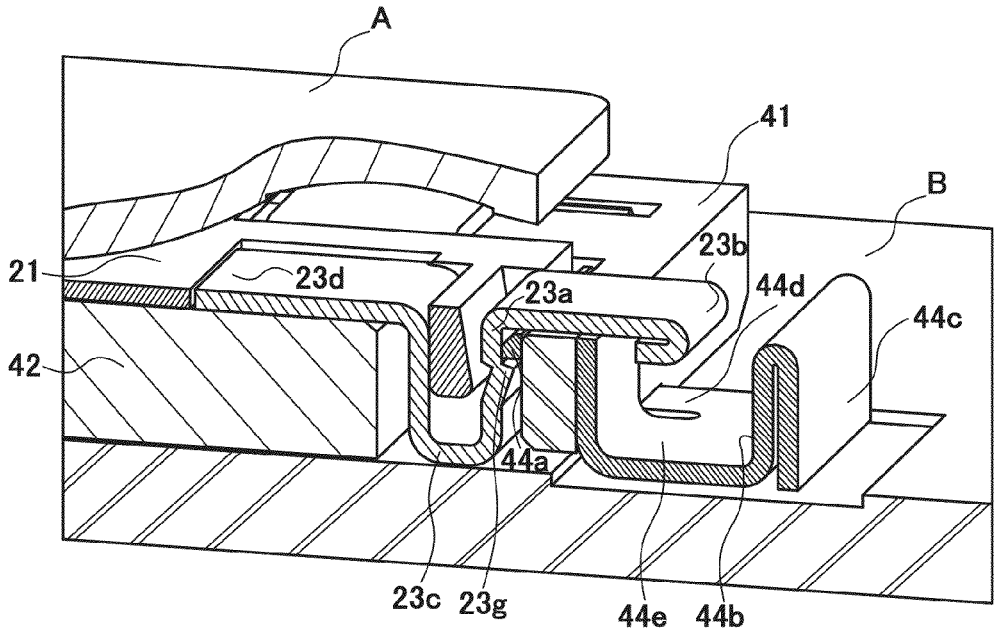
FIG. 9B is an enlarged cross-sectional view of the locking part and part to be locked of the electrical connector shown in FIG. 9A.

The engaging portion 44*a* is, for example, as shown in FIG. 9B, placed against the wall of the receptacle housing 41 facing the latching portion 23*a* when the plug connector 20 and receptacle connector 40 are mated. Here, FIG. 9B is a cross-sectional view at S4-S4 shown in FIG. 9A, in which the flexible substrate A is partially cut away for the purpose of convenience.

Figure 10A:
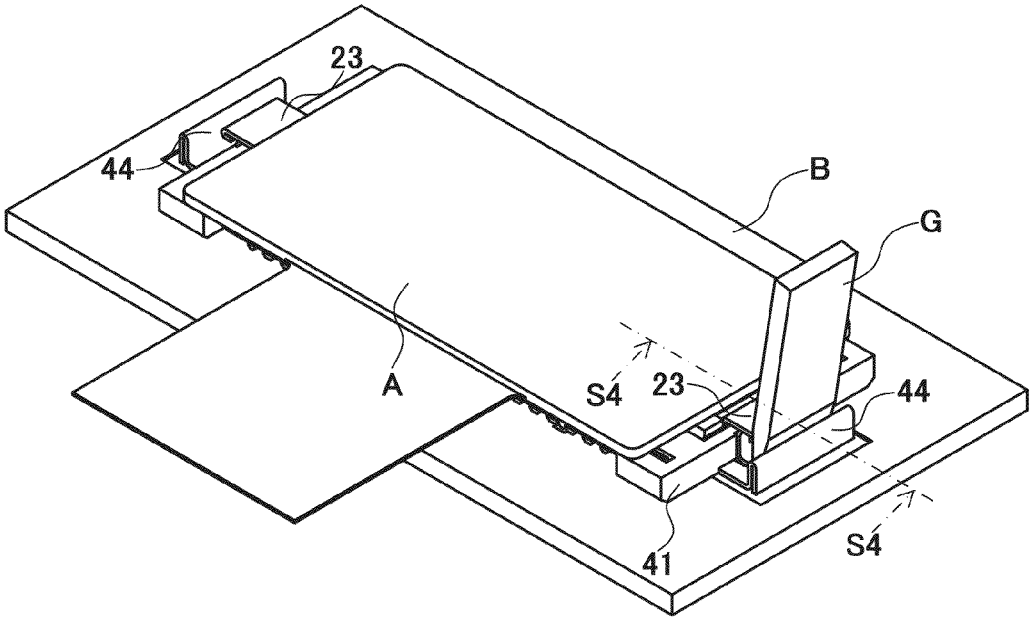
FIG. 10A is a perspective view of the electrical connector when a jig is inserted in the slot.

The supporting portion 44*b* is a flat rectangular plate of, for example, metal, as shown in FIGS. 6 and 7. The supporting portion 44*b* is laid in an xz-plane as shown in FIGS. 6 and 7. When the plug connector 20 and receptacle connector 40 are mated, for example, as shown in FIGS. 9A and 10A, the supporting portion 44*b* forms a slot into which a rod-like jig G can be inserted in cooperation with the operation portion 23*b*.

The reinforcing portion 44*c* has an inverted J shape projecting in the z-direction in a cross section S3-S3 as shown in FIG. 6. The reinforcing portion 44*c* is formed of, for example, a metal. The planar section of the reinforcing portion 44*c* is laid in an xz-plane as shown in FIGS. 6 and 7. One end of the reinforcing portion 44*c* is connected continuously from one end of the supporting portion 44*b*. The other end of the reinforcing portion 44*c* is soldered to the contact point of the circuit substrate B as shown in FIG. 5. Thus, the reinforcing portion 44*c* and supporting portion 44*b* present an inverted U shape projecting in the z-direction in a cross section S3-S3 as shown in FIG. 6.

Figure 10B:
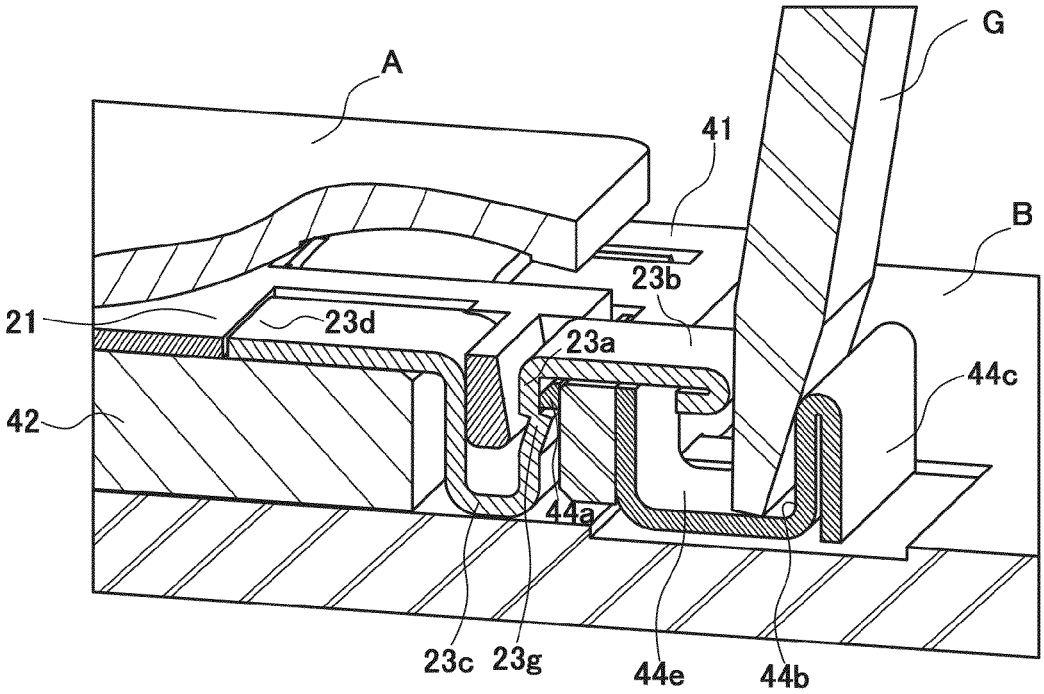
FIG. 10B is an enlarged cross-sectional view of the locking part and part to be locked of the electrical connector shown in FIG. 10A.

The one end of the reinforcing portion 44*c* is connected continuously from the one end of the supporting portion 44*b* outside the slot as shown in FIGS. 9B and 10B. Here, FIG. 10B is a cross-sectional view at S4-S4 shown in FIG. 10A, in which the flexible substrate A is partially cut away for the purpose of convenience. Here, in order to separate the mated plug connector 20 and receptacle connector 40, the worker inserts a jig (for example, a flat-blade screwdriver or the like) G into the slot as shown in FIG. 10B. Then, the worker operates the jig G as a lever using the supporting portion 44*b* as the fulcrum point so that the jig G abuts against the operation portion 23*b* and applies a force to disengage the latching portion 23*a* and engaging portion 44*a*. At this point, the reinforcing portion 44*c* reinforces the supporting portion 44*b* to improve the rigidity of the supporting portion 44*b* so that the supporting portion 44*b* does not break.

The coupling portion 44*d* is a flat rectangular plate of metal coupling the supporting portion 44*b* and engaging portion 44*a* as shown in FIGS. 6 and 7. The coupling portion 44*d* is punched out in part. The coupling portion 44*d* is soldered to the contact point of the circuit substrate B. The coupling portion 44*d* is laid in an xy-plane as shown in FIGS. 6 and 7. One end of the coupling portion 44*d* is connected continuously from one end of the engaging portion 44*a* as shown in FIG. 6. The other end of the coupling portion 44*d* is connected continuously from the other end of the supporting portion 44*b* as shown in FIG. 7.

The protective portion 44*e* is a metal having an L shape in a cross section S3-S3 as shown in FIG. 6. One of the planar sections forming the L-shaped cross section is laid in an xz-plane as shown in FIGS. 6 and 7. Furthermore, the other of the planar sections forming the L-shaped cross section is laid in an xy-plane as shown in FIGS. 6 and 7. This other planar section is connected continuously from the other end of the supporting portion 44*b* and the other end of the coupling portion 44*d* as shown in FIG. 7.

When the plug connector 20 and receptacle connector 40 are mated, the protective portion 44*e* is connected continuously from the other end of the supporting portion 44*b* within the slot and extends towards the operation portion 23*b* as shown in FIGS. 9B and 10B. Thus, the protective portion 44*e* can protect the other members (for example, the receptacle housing 41, circuit substrate B, or the like) from being damaged by contacting with the jig G inserted in the slot.

Furthermore, the one planar section of the protective portion 44*e* creates a certain space with the engaging portion 44*a* as shown in FIGS. 6 and 7. For mounting the part to be locked 44 on the receptacle housing 41, the worker interposes the wall of the receptacle housing 41 into this space so as to mount the part to be locked 44 on the receptacle housing 41 firmly as shown in FIG. 5.

Furthermore, for mounting the part to be locked 44 on the receptacle housing 41, the worker presses and fastens the wedged fixtures formed at least both ends of the engaging portion 44*a* into the not-shown grooves formed in the wall of the receptacle housing 41 as shown in FIG. 5. This also makes it possible to mount the part to be locked 44 on the receptacle housing 41 firmly. Incidentally, the worker can fasten the entire engaging portion 44*a* on the wall of the receptacle housing 41.

For mating the above-described plug connector 20 and receptacle connector 40, the worker places the plug connector 20 mounted on, for example, a flexible substrate A and the receptacle connector 40 mounted on, for example, a circuit substrate B directly face-to-face as shown in FIG. 1.

Figure 8A:
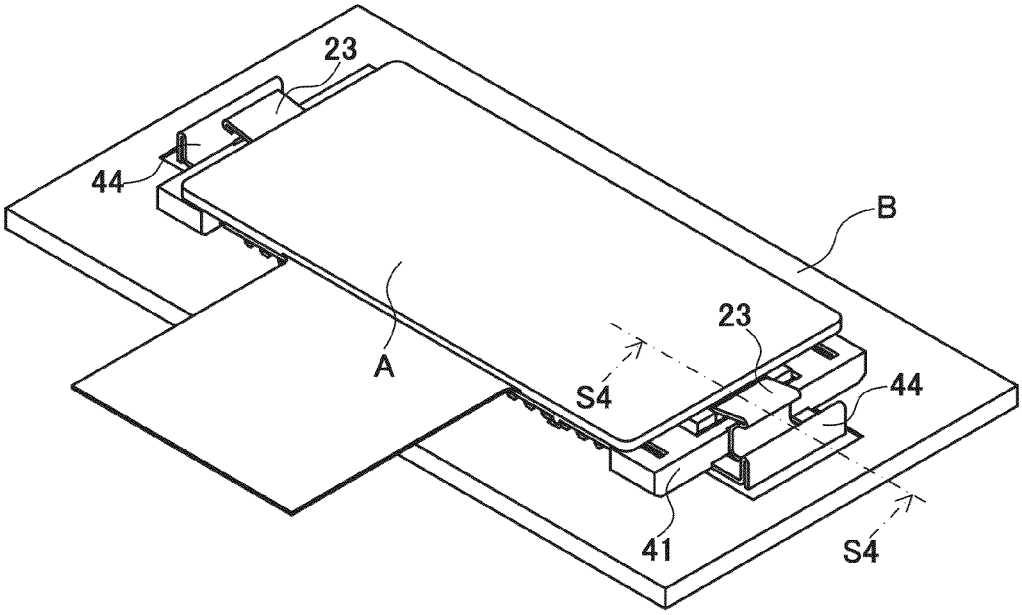
FIG. 8A is a perspective view of the electrical connector when the plug connector and receptacle connector are mated insufficiently.
Figure 8B:
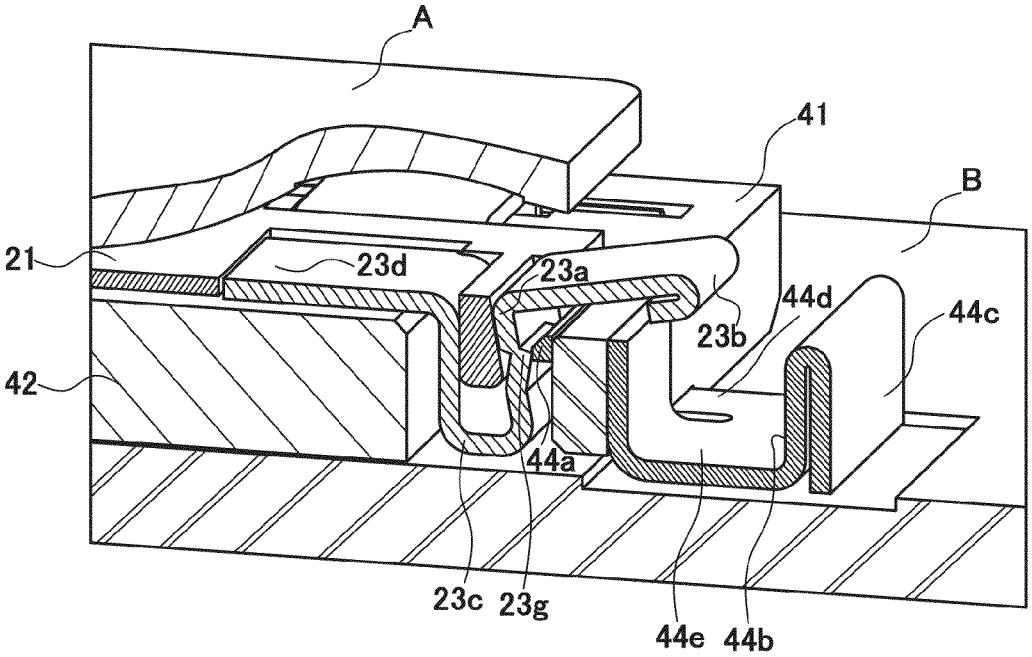
FIG. 8B is an enlarged cross-sectional view of the locking part and part to be locked of the electrical connector shown in FIG. 8A.

Then, the worker presses the plug housing 21 into the receptacle housing 41 as shown in FIGS. 8A and 8B. Here, FIG. 8B is a cross-sectional view at S4-S4 shown in FIG. 8A, in which the flexible substrate A is partially cut away for the purpose of convenience.

At this point, the latching piece 23*g* provided at the latching portion 23*a* is positioned to face the engaging hole 44*f* of the engaging portion 44*a* when the plug housing 21 and receptacle housing 41 are mated correctly.

Therefore, as shown in FIGS. 8A and 8B, when the plug housing 21 and receptacle housing 41 are mated insufficiently (when the latching piece 23*g* and engaging hole 44*f* are engaged insufficiently), the latching piece 23*g* stays abutted against the plate-like surface of the engaging portion 44*a*.

In this state, the latching piece 23*g* deforms the elastic portion 23*c* and moves the operation portion 23*b* from the position where the operation portion 23*b* is nearly parallel to the flexible substrate A to a position where the operation portion 23*b* is tilted with respect to the flexible substrate A. Consequently, the latching piece 23*g* enlarges the slot compared with when the latching piece 23*g* and engaging hole 44*f* are engaged correctly (the state shown in FIGS. 9A and 9B).

Thus, seeing the enlarged slot, the worker can easily notice that the latching piece 23*g* and engaging hole 44*f* are engaged insufficiently and the plug connector 20 and receptacle connector 40 are incompletely mated.

Noticing that the plug connector 20 and receptacle connector 40 are incompletely mated, the worker further presses the plug housing 21 into the receptacle housing 41. Consequently, the latching piece 23*g* is engaged with the engaging hole 44*f* of the engaging portion 44*a* (not abutting against the plate-like surface of the engaging portion 44*a*) as shown in FIGS. 9A and 9B.

Then, the slot is narrowed from the enlarged state to the normal state (the state in which the operation portion 23*b* is nearly parallel to the flexible substrate A). Thus, seeing the slot in the normal state, the worker can easily notice that the engaging piece 23*g* and engaging hole 44*f* are engaged correctly and the plug connector 20 and receptacle connector 40 are completely mated (the plug housing 21 and receptacle housing 41 are mated).

After the plug connector 20 and receptacle connector 40 are completely mated, the plug contacts 22 and receptacle contacts 43 are in contact and the plug contacts 22 and receptacle contacts 43 are electrically connected.

Then, in order to separate the mated plug connector 20 and receptacle connector 40 for replacing the plug connector 20, the worker inserts a rod-like jig (for example, a flat-blade screwdriver or the like) into the slot and operates the jig G as a lever using the supporting portion 44*b* as the fulcrum point as shown in FIGS. 10A and 10B.

Figure 11A:
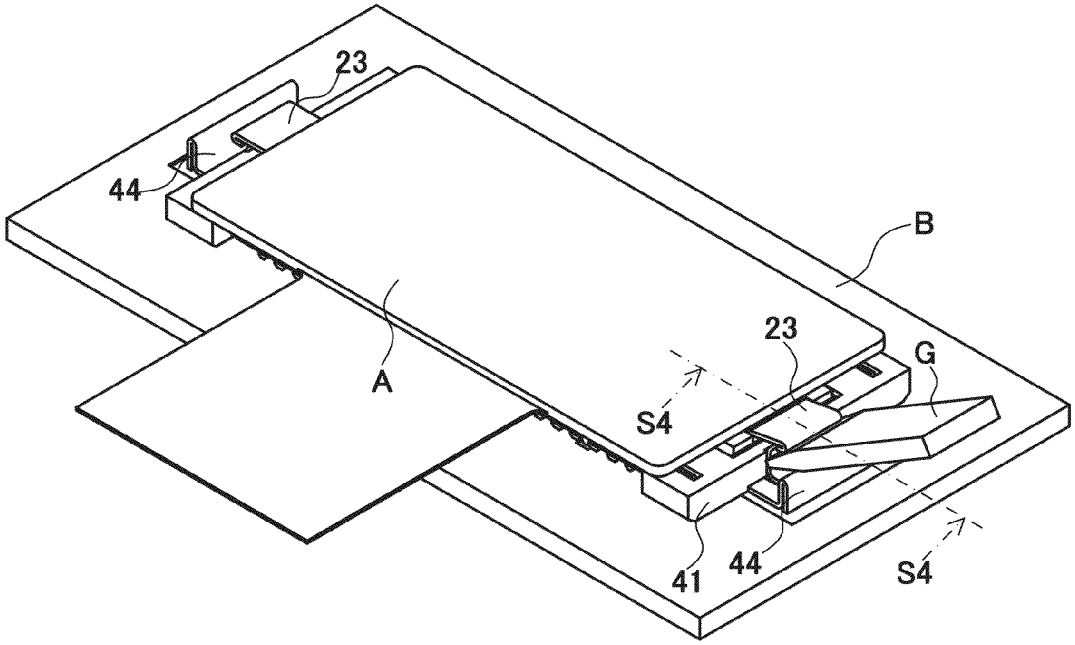
FIG. 11A is a perspective view of the electrical connector when the latching piece and engaging hole are disengaged.
Figure 11B:
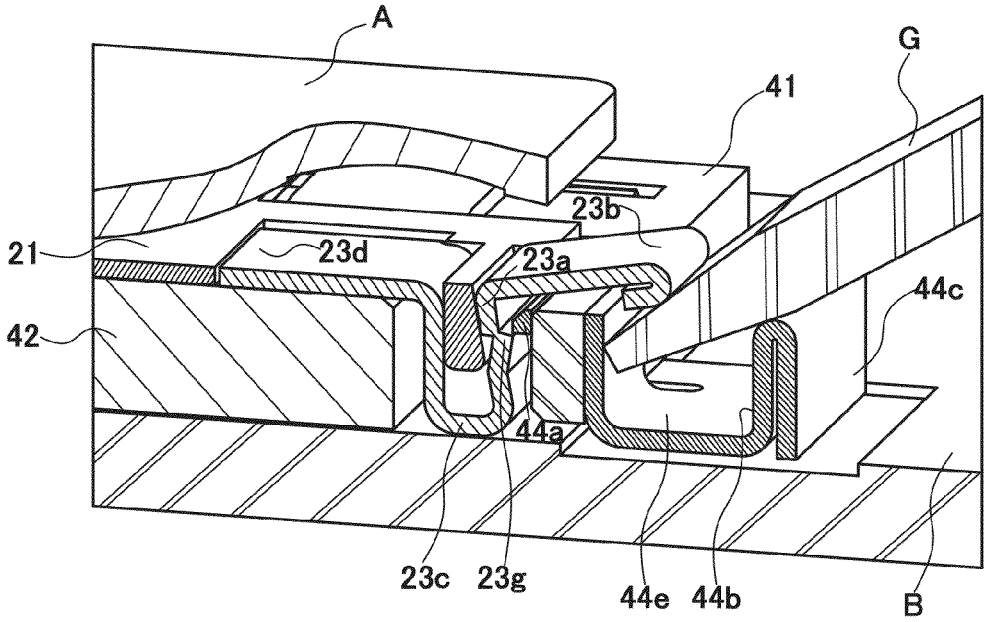
FIG. 11B is an enlarged cross-sectional view of the locking part and part to be locked of the electrical connector shown in FIG. 11A.

Then, the jig working as a lever abuts against the operation portion 23*b* and deforms the elastic portion 23*c* as shown in FIGS. 11A and 11B. Consequently, the latching piece 23*g* and engaging hole 44*f* are disengaged. Here, the FIG. 11B is a cross-sectional view at S4-S4 shown in FIG. 11A, in which the flexible substrate A is partially cut away for the purpose of convenience.

Figure 12A:
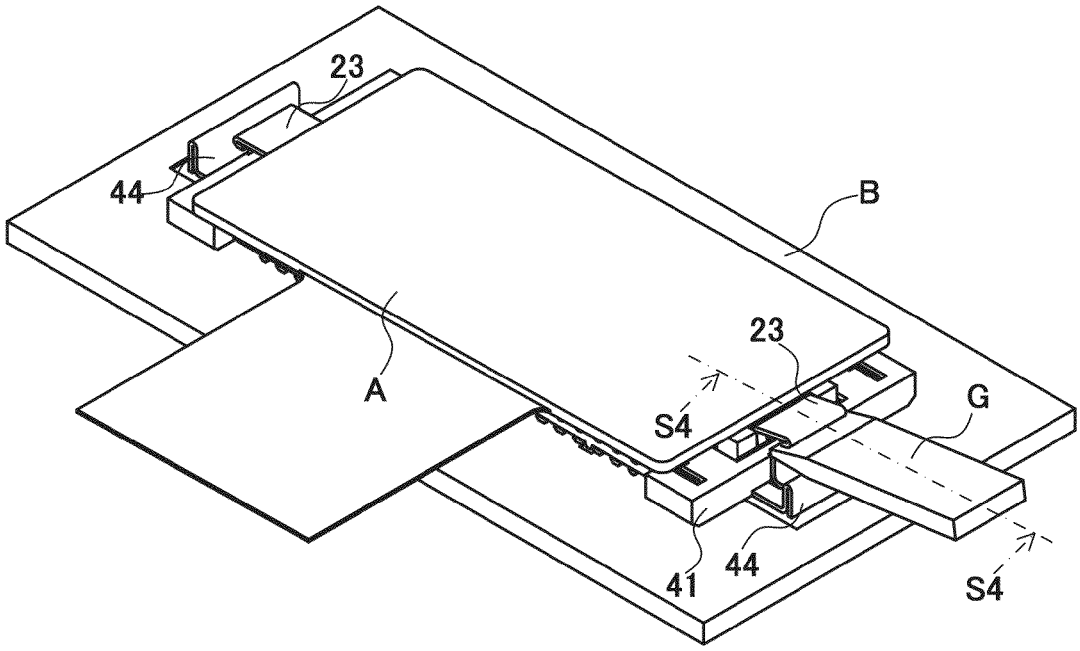
FIG. 12A is a perspective view of the electrical connector when the mated plug connector and receptacle connector are separated.
Figure 12B:
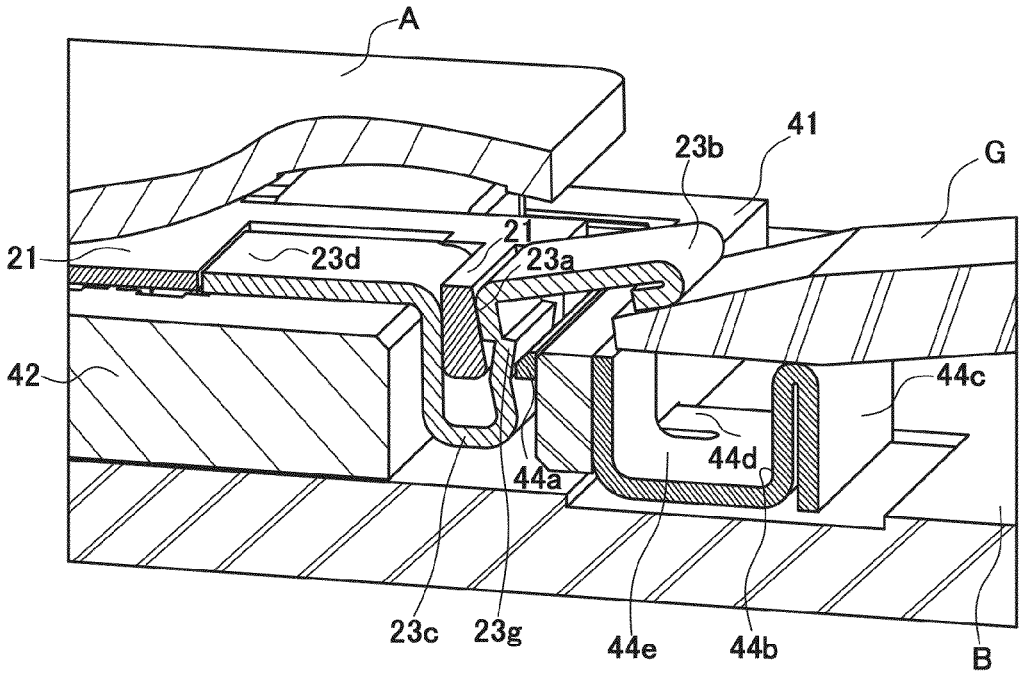
FIG. 12B is an enlarged cross-sectional view of the locking part and part to be locked of the electrical connector shown in FIG. 12A.

Then, the worker further operates the jig G as a lever and applies force to the operation portion 23*b* to separate the mated plug connector 20 and receptacle connector 40 as shown in FIGS. 12A and 12B. Here, the FIG. 12B is a cross-sectional view at S4-S4 marked in FIG. 12A, in which the flexible substrate A is partially cut away for the purpose of convenience.

As described above, the worker can operate the jig G as a lever using the supporting portion 44*b* as the fulcrum point, reducing the possibility that the tip of the jig G comes off the operation portion 23*b* or it is difficult to apply the force from the jig G to the operation portion 23*b*.

Here, if the worker abuts the jig G working as a lever against the operation portion 23*b* with greater force than usual for some reason, the latching portion 23*a* abuts against the wall of the plug housing 21 as shown in FIGS. 12A and 12B.

As stated above, the latching portion 23*a* is provided to abut against the wall of the plug housing 21 when a greater force than usual is applied to the operation portion 23*b*. Consequently, the plug housing 21 and latching portion 23*a* can limit the deformation of the elastic portion 23*c* and prevent the elastic force of the elastic portion 23*c* from being impaired even if the elastic portion 23*c* is deformed more than normally.

As described above, provided with the supporting portion 44*b*, the electrical connector 10 of this embodiment can serve as the fulcrum point for operating the jig as a lever. Thus, the electrical connector 10 of this embodiment can improve the operability of the jig and prevent the worker from spending an unexpected length of time in order to separate the mated connectors.

Furthermore, unlike the prior art electrical connector, the electrical connector 10 of this embodiment does not require a fine jig operation such as insertion of the tip of a rod-like jig into the jig insert hole in order to separate the mated plug connector 20 and receptacle connector 40. Therefore, the electrical connector 10 of this embodiment can prevent the worker from spending an unexpected length of time in order to separate the mated connectors.

Furthermore, for example in the case of design change, when the numbers of the plug contacts 22 and receptacle contacts 43 are increased/decreased and the plug housing 21 and receptacle housing 41 are changed in size, the electrical connector 10 of this embodiment allows the worker to conduct the same operation using the same jig as before the change in order to separate the mated plug connector 20 and receptacle connector 40.

In other words, the worker does not need to change the jig to use or change the operation details even if the plug housing 21 and receptacle housing 41 are changed in size. Therefore, the electrical connector 10 of this embodiment can prevent the worker from spending an unexpected length of time in order to separate the mated connectors because of use of an unfamiliar jig.

An embodiment of the present disclosure is described above. This disclosure is not confined to the above embodiment and various modifications and applications are available.

In the electrical connector 10 of the above-described embodiment, the locking parts 23 are provided to the plug connector 20 and the parts to be locked 44 are provided to the receptacle connector 40. This is not restrictive.

The electrical connector 10 can be constructed with the parts to be locked 44 provided to the plug connector 20 and the locking parts 23 provided to the receptacle connector 40. Also with this structure, provided with the supporting portion 44*b*, the electrical connector 10 can serve as the fulcrum point for operating a jig as a lever. Thus, the electrical connector 10 of this embodiment can improve the operability of the jig and prevent the worker from spending an unexpected length of time in order to separate the mated connectors.

The electrical connector 10 of the above-described embodiment includes the locking parts 23 at both ends of the plug housing 21 and the parts to be locked 44 at both ends of the receptacle housing 41. In other words, the electrical connector 10 of the above-described embodiment includes two sets of the locking parts 23 and parts to be locked 44.

However, this not restrictive. The electrical connector 10 can include, for example, four sets of the locking parts 23 and parts to be locked 44. Furthermore, the electrical connector 10 can include, for example, one set of the locking part 23 and part to be locked 44.

When one set of the locking part 23 and part to be locked 44 is provided, the electrical connector 10 may include, for example, an L-shaped hook on the wall of the plug housing 21 opposite to the locking part 23 and, for example, a hooked portion in which a catch hole is formed on the wall of the receptacle housing 41 opposite to the part to be locked 44. For mating the plug connector 20 and receptacle connector 40, the worker can make the hook caught by the hooked portion, rotate the plug connector 20 with respect to the receptacle connector 40 using the hook as the fulcrum point, and then press the plug housing 21 into the receptacle housing 41.

Various embodiments and modifications are available to the present disclosure without departing from the broad sense of spirit and scope of the present disclosure. The above-described embodiment is given for explaining the present disclosure and does not confine the scope of the present disclosure. In other words, the scope of the present disclosure is set forth by the scope of claims, not by the embodiment. Various modifications made within the scope of claims and scope of significance of the disclosure equivalent thereto are considered to fall under the scope of the present disclosure.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

10 Electrical connector, 20 Plug connector, 21 Plug housing, 22 Plug contact, 23 Locking part, 23*a* Latching portion, 23*b* Operation portion, 23*c* Elastic portion, 23*d* Base, 23*e* Mounting portion, 23*f* Joint, 23*g* Engaging piece, 40 Receptacle connector, 41 Receptacle housing, 42 Block, 43 Receptacle contact, 44 Part to be locked, 44*a* Engaging portion, 44*b* Supporting portion, 44*c* Reinforcing portion, 44*d* Coupling portion, 44*e* Protective portion, and 44*f* Engaging hole.

What is claimed is:

1. An electrical connector, comprising:

a first connector comprising a first housing forming an internal region with an insulation wall, and first contacts that are conductive members extending from the wall of the internal region toward the outside of the first housing; and a second connector comprising a second housing comprising an insulating wall that is placed at least in part within the internal region of the first housing, and second contacts that are conductive members extending from the wall of the second housing toward the outside of the second housing, in which the first contacts and the second contacts are electrically connected when the first housing and the second housing are mated, wherein one of the first connector or the second connector comprises:

a latching portion positioned to face the wall of the housing of the other connector when the housing of one connector and the housing of the other connector are mated;

an operation portion extending outward from one connector and connected to one end of the latching portion; and an elastic portion comprising a flexible member that is connected to the other end of the latching portion and mounted on the wall of the housing of one connector, and the other connector comprises:

an engaging portion provided on the wall of the housing of the other connector facing the latching portion when the housing of one connector and the housing of the other connector are mated for engaging with the latching portion; and a supporting portion that is a plate-like member forming a slot into which a jig can be inserted in cooperation with the operation portion when the housing of one connector and the housing of the other connector are mated and serving as the fulcrum point of leverage while the jig inserted in the slot and working as a lever abuts against the operation portion therefor deforming the elastic portion so as to disengage the latching portion and engaging portion from each other.

2. The electrical connector according to claim 1, wherein the other connector comprises a protective portion connected continuously to the supporting portion within the slot and extending toward the operation portion for protecting the other members from being damaged by contacting with the jig working as a lever.

3. The electrical connector according to claim 1, wherein the other connector comprises a reinforcing portion that is a plate-like member connected continuously to the supporting portion outside the slot and reinforces the supporting portion for improving the rigidity of the supporting portion.

4. The electrical connector according to claim 1, wherein the latching portion abuts against the wall of the housing of one connector to limit the deformation of the elastic portion when the elastic portion deforms under the leverage of the jig.

5. The electrical connector according to claim 1, wherein the latching portion comprises a latching piece in the shape of a protrusion, the engaging portion is a plate-like member provided with an engaging hole for engaging with the latching piece, and the latching piece abuts against the plate-like surface of the engaging portion and deforms the elastic portion when the housing of one connector and the housing of the other connector are mated and the latching piece is not engaged with the engaging hole so as to change the position of the operation portion and enlarge the slot compared with when the latching piece is engaged with the engaging hole.

6. The electrical connector according to claim 1, wherein the engaging portion and the supporting portion are formed by a sheet of plate, and the engaging portion is fastened to the wall of the housing of the other connector.

7. The electrical connector according to claim 1, wherein one connector comprises at least two of the elastic portions, the latching portions, and the operation portions at opposite positions, and the other connector comprises at least two of the engaging portions and the supporting portions at opposite positions.

* * * * *